US007578659B2

(12) United States Patent
Fox et al.

(10) Patent No.: US 7,578,659 B2
(45) Date of Patent: Aug. 25, 2009

(54) COMPRESSOR DISCHARGE MUFFLER

(75) Inventors: William Joseph Fox, Dover, PA (US); Robert Clarence Sleighter, Jr., Fayetteville, PA (US); Robert Stanley Miller, Chambersburg, PA (US); James Edwin Bender, York Haven, PA (US)

(73) Assignee: York International Corporation, York, PA (US)

( * ) Notice: Subject to any disclaimer, the term of this patent is extended or adjusted under 35 U.S.C. 154(b) by 627 days.

(21) Appl. No.: 11/047,552

(22) Filed: Jan. 31, 2005

(65) Prior Publication Data

US 2006/0171819 A1 Aug. 3, 2006

(51) Int. Cl.
*F04B 53/00* (2006.01)
*F01N 7/00* (2006.01)

(52) U.S. Cl. ..... 417/312; 181/238

(58) Field of Classification Search ..... 181/403, 181/212, 238; 417/312
See application file for complete search history.

(56) References Cited

U.S. PATENT DOCUMENTS

| | | | | | |
|---|---|---|---|---|---|
| 2,205,899 | A | * | 6/1940 | Chipley | 181/269 |
| 3,066,857 | A | * | 12/1962 | McCloy | 417/363 |
| 3,473,479 | A | * | 10/1969 | Sundholm | 417/553 |
| 3,577,891 | A | * | 5/1971 | Nemoto et al. | 92/72 |
| 3,698,840 | A | | 10/1972 | Hover | |
| 4,033,707 | A | | 7/1977 | Stutzman | |
| 4,108,276 | A | * | 8/1978 | Hall et al. | 181/256 |
| 4,111,278 | A | | 9/1978 | Bergman | |
| 4,255,940 | A | * | 3/1981 | Grahl et al. | 62/324.3 |
| 4,330,239 | A | | 5/1982 | Gannaway | |
| 4,370,104 | A | | 1/1983 | Nelson et al. | |
| 4,401,418 | A | | 8/1983 | Fritchman | |
| 4,573,880 | A | | 3/1986 | Hirano et al. | |
| 4,610,604 | A | * | 9/1986 | Iwamori | 417/269 |
| 5,146,764 | A | | 9/1992 | Bauman et al. | |
| 5,205,719 | A | | 4/1993 | Childs et al. | |
| 5,248,859 | A | * | 9/1993 | Borla | 181/238 |
| 5,261,202 | A | * | 11/1993 | Brunet et al. | 52/202 |
| 5,341,654 | A | | 8/1994 | Hewette et al. | |

(Continued)

FOREIGN PATENT DOCUMENTS

EP 0743456 A2 11/1996

(Continued)

OTHER PUBLICATIONS

Nakahata, Hiroshi / Uchiyama, Hironobu / Kurata, Junichi; *Control of prominent level noise in discrete frequency with adjustable muffler*; Nippon Kikai Gakkai Kansai Shibu Teijl Sokai Koenkai Koen Ronbunshu, 1997, vol. 72$^{nd}$, p. 10.15-10.16.

(Continued)

*Primary Examiner*—Charles G Freay
(74) *Attorney, Agent, or Firm*—McNees Wallace, Nurick, LLC

(57) ABSTRACT

A discharge muffler (20) in an HVAC&R system (100) includes a plurality of tubes (34, 38, 42) of predetermined length that are disposed at a predetermined spacing in substantially mutual axial alignment by a plate (30). The tubes (34, 38, 42) are secured adjacent to a compressor discharge (24) to minimize pressure reduction, improve flow characteristics and improve efficiency of the HVAC&R system (100).

25 Claims, 5 Drawing Sheets

U.S. PATENT DOCUMENTS

| | | | | | |
|---|---|---|---|---|---|
| 5,373,119 | A | * | 12/1994 | Suzuki et al. | 181/230 |
| 5,451,727 | A | | 9/1995 | Park | |
| 5,496,156 | A | | 3/1996 | Harper et al. | |
| 5,507,151 | A | | 4/1996 | Ring et al. | |
| 5,542,824 | A | * | 8/1996 | Lee | 417/312 |
| 5,577,898 | A | | 11/1996 | Lee | |
| 5,583,325 | A | * | 12/1996 | Schutte et al. | 181/237 |
| 5,705,777 | A | | 1/1998 | Flanigan et al. | |
| 5,733,106 | A | * | 3/1998 | Lee | 417/312 |
| 5,780,785 | A | * | 7/1998 | Eckel | 181/295 |
| 5,803,717 | A | | 9/1998 | Iversen et al. | |
| 5,936,210 | A | | 8/1999 | Borneby et al. | |
| 5,938,411 | A | * | 8/1999 | Seo | 417/312 |
| 5,979,597 | A | | 11/1999 | Grolier | |
| 5,996,731 | A | | 12/1999 | Czabala et al. | |
| 6,017,197 | A | | 1/2000 | Jensen et al. | |
| 6,062,033 | A | | 5/2000 | Choi | |
| 6,129,522 | A | * | 10/2000 | Seo | 417/312 |
| 6,149,402 | A | * | 11/2000 | Kim | 417/312 |
| 6,176,688 | B1 | | 1/2001 | Collings et al. | |
| 6,331,103 | B1 | * | 12/2001 | Teraoka | 418/181 |
| 6,382,931 | B1 | | 5/2002 | Czabala et al. | |
| 6,398,520 | B2 | | 6/2002 | Han | |
| 6,398,523 | B1 | | 6/2002 | Hur et al. | |
| 6,446,454 | B1 | | 9/2002 | Lee et al. | |
| 6,488,482 | B1 | | 12/2002 | Yannascoli et al. | |
| 6,547,535 | B2 | | 4/2003 | Kueon | |
| 6,572,345 | B2 | | 6/2003 | Seo | |
| 6,599,099 | B2 | * | 7/2003 | Seo | 417/312 |
| 6,626,648 | B1 | | 9/2003 | Kim | |
| 6,692,238 | B2 | | 2/2004 | Myung et al. | |
| 2001/0031208 | A1 | | 10/2001 | Chintamani et al. | |
| 2001/0050198 | A1 | | 12/2001 | An et al. | |
| 2002/0006342 | A1 | | 1/2002 | Han | |
| 2002/0034450 | A1 | | 3/2002 | Svendsen et al. | |
| 2002/0035844 | A1 | | 3/2002 | Lee et al. | |
| 2002/0076335 | A1 | | 6/2002 | Silveira et al. | |
| 2002/0081217 | A1 | | 6/2002 | Kueon | |
| 2002/0090305 | A1 | | 7/2002 | Myung et al. | |
| 2002/0098093 | A1 | | 7/2002 | Tomell et al. | |
| 2002/0136646 | A1 | | 9/2002 | Seo | |
| 2002/0141885 | A1 | | 10/2002 | Seo | |
| 2002/0185333 | A1 | | 12/2002 | Svendsen | |
| 2003/0108438 | A1 | | 6/2003 | Kim et al. | |
| 2004/0005225 | A1 | | 1/2004 | Marshall et al. | |
| 2004/0037693 | A1 | | 2/2004 | Stabley et al. | |
| 2004/0071564 | A1 | | 4/2004 | Froeslev et al. | |
| 2004/0091370 | A1 | | 5/2004 | Yoon et al. | |
| 2004/0096338 | A1 | | 5/2004 | Cheon | |
| 2004/0126247 | A1 | | 7/2004 | Broser et al. | |
| 2004/0154330 | A1 | | 8/2004 | Ko et al. | |
| 2004/0170506 | A1 | | 9/2004 | Lilie et al. | |
| 2004/0175280 | A1 | | 9/2004 | Seo | |
| 2004/0179955 | A1 | | 9/2004 | Lee | |

FOREIGN PATENT DOCUMENTS

| | | | |
|---|---|---|---|
| EP | 1 304 481 | A1 | 4/2003 |
| GB | 2 088 947 | A | 6/1982 |
| GB | 2 097 866 | A | 11/1982 |
| GB | 2 136 511 | A | 9/1984 |
| GB | 2 257 757 | A | 1/1993 |
| GB | 2 268 981 | A | 1/1994 |
| JP | 62-247196 | | 10/1987 |
| JP | 3-175177 | | 7/1991 |
| JP | 4-72474 | | 3/1992 |
| JP | 5-157046 | | 6/1993 |
| JP | 07133774 | A | 5/1995 |
| JP | 11-351144 | | 12/1999 |
| JP | 2002-21527 | | 1/2002 |
| JP | 2002-276547 | | 9/2002 |
| WO | WO 97/01036 | | 1/1997 |
| WO | WO 99/36680 | | 7/1999 |
| WO | WO 99/43932 | | 9/1999 |

OTHER PUBLICATIONS

Stosic, N. / Smith, Ian K. / Kovacevis, A.; *Rotor interference as a criterion for screw compressor design*; Journal of Engineering Design, vol. 14 No. 2, 2003, p. 209-20; Publisher: Taylor & Francis, UK.

Lee, G.H.; *Performance simulation of scroll compressors*; Proceedings of the Institution of Mechanical Engineers Part A—Journal of Power & Energy, vol. 216 No. A2, 2002, p. 169-79; Publisher: Mechanical Engineers Publications, UK.

* cited by examiner

60

COMPRESSOR DISCHARGE MUFFLER

FIELD OF THE INVENTION

The present invention is directed to a discharge muffler for a compressor used in heating, ventilation, air conditioning and refrigeration systems, and more particularly to a discharge muffler that provides sound attenuation with minimum discharge pressure reduction.

BACKGROUND OF THE INVENTION

Heating and cooling systems typically maintain temperature control in a structure by circulating a fluid within coiled tubes such that passing another fluid over the tubes effects a transfer of thermal energy between the two fluids. A primary component in such a system is a compressor which receives a cool, low pressure gas and by virtue of a compression device, exhausts a hot, high pressure gas. One type of compressor is a screw compressor, which generally includes two cylindrical rotors mounted on separate shafts inside a hollow, double-barreled casing. The side-walls of the compressor casing typically form two parallel, overlapping cylinders which house the rotors side-by-side, with their shafts parallel to the ground. Screw compressor rotors typically have helically extending lobes and grooves on their outer surfaces forming a large thread on the circumference of the rotor. During operation, the threads of the rotors mesh together, with the lobes on one rotor meshing with the corresponding grooves on the other rotor to form a series of gaps between the rotors. These gaps form a continuous compression chamber that communicates with the compressor inlet opening, or "port," at one end of the casing and continuously reduces in volume as the rotors turn and compress the gas toward a discharge port at the opposite end of the casing for use in the system.

These rotors rotate at high rates of speed, and multiple sets of rotors (compressors) may be configured to work together to further increase the amount of gas that can be circulated in the system, thereby increasing the operating capacity of a system. While the rotors provide a continuous pumping action, each set of rotors (compressor) produces pressure pulses as the pressurized fluid is discharged at the discharge port. These discharge pressure pulsations act as significant sources of audible sound within the system.

To minimize the undesirable sound, noise attenuation devices or systems can be used. Examples of noise attenuation systems include a dissipative or absorptive muffler system and a restrictive muffler system that subjects the refrigerant to a tortuous path, each typically located at the compressor discharge. Mufflers typically cause a significant pressure drop downstream of the compressor discharge which reduces system efficiency.

What is needed is a muffler that sufficiently attenuates pressure pulsations generated by compressor operations without adversely affecting compressor operating efficiency.

SUMMARY OF THE INVENTION

The present invention is directed to a discharge muffler for a compressor in a HVAC&R system. The discharge muffler includes a plate; and a plurality of tubes configured and disposed to extend through the plate substantially perpendicular to the plate, the plurality of tubes disposed in a predetermined spacing arrangement to provide substantially mutual axial alignment of the plurality of plates.

The present invention is further directed to a compressor system in a HVAC&R system. The compressor system includes a compressor having a housing, the housing having an inlet for receiving refrigerant to be compressed by the compressor and an outlet for discharging pressurized compressed refrigerant. A muffler disposed in the outlet includes a plate and a plurality of tubes configured and disposed to extend through the plate substantially perpendicular to the plate. The plurality of tubes are disposed in a predetermined spacing arrangement to provide substantially mutual axial alignment of the plurality of plates.

The present invention is still further directed to a chiller system including a compressor, a condenser arrangement and an evaporator arrangement connected in a closed refrigerant loop. A muffler includes a plate and a plurality of tubes configured and disposed to extend through the plate substantially perpendicular to the plate, the plurality of tubes disposed in a predetermined spacing arrangement to provide substantially mutual axial alignment of the plurality of plates. The muffler is disposed in the closed refrigerant loop between the compressor and the condenser.

An advantage of the present invention is that it can provide sound attenuation with minimal discharge pressure reduction.

A further advantage of the present invention is a muffler that provides improved discharge flow characteristics from the compressor.

A still further advantage of the present invention is improved HVAC&R system efficiency.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Wherever possible, the same reference numbers will be used throughout the drawings to refer to the same or like parts.

DETAILED DESCRIPTION OF THE INVENTION

Figure 1:
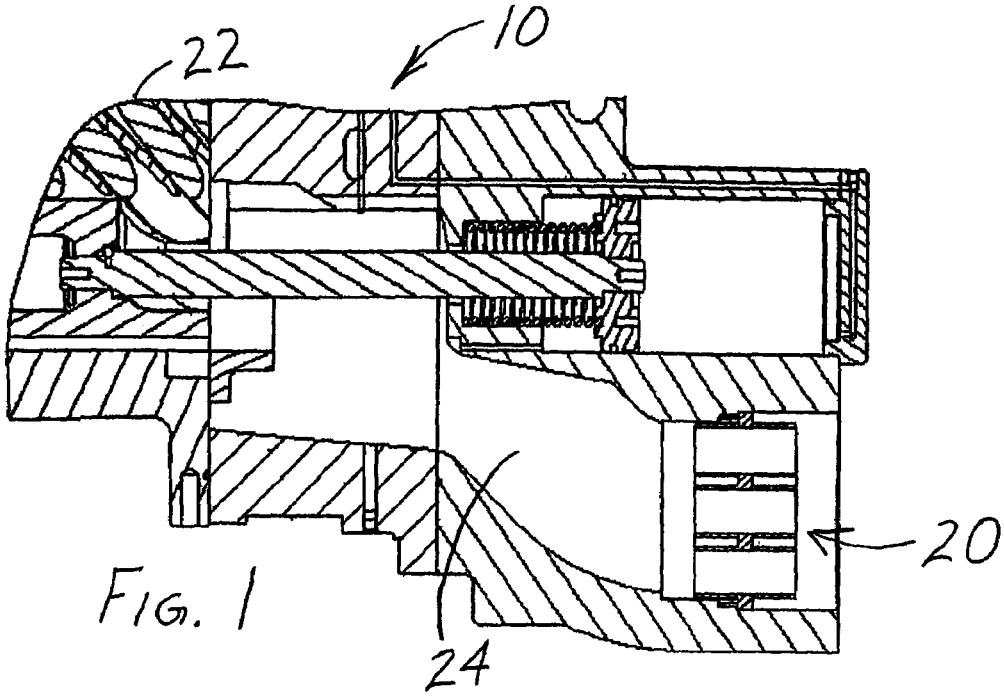
FIG. 1 is a partial cross section of a compressor, including a discharge for receiving a discharge muffler of the present invention.

One embodiment of a discharge muffler 20 is depicted in FIGS. 1-4. A compressor 10, such as a screw compressor includes meshing rotors 22 that compress refrigerant vapor received at an inlet of the compressor, discharging the compressed vapor refrigerant at an outlet or discharge 24. Compressor 10 is installed in discharge 24 in fluid communication with the vapor refrigerant prior to the refrigerant vapor flowing toward other components in a heating, ventilation and air conditioning and refrigeration (HVAC&R) system. A plate or reflector 30 has a plurality of apertures 32 formed therein for receiving tubes, such as tubes 34, 38 and 42, and is preferably secured in discharge 24 by plurality of fasteners (not shown) inserted through peripherally disposed apertures 52. Preferably, a plurality of vanes 46 is affixed to opposing sides of reflector 30. The tubes 34, 38, 42 and vanes 46 attenuate certain pressure pulsation frequencies generated by operation of the compressor 10 while improving compressor efficiency to be discussed in further detail below.

Plate or reflector 30 is comprised of a material, such as metal, that can withstand pulsating pressurized refrigerant vapor discharged by compressor 10. Additionally, upon installation in the discharge 24, reflector 30 reflects a portion of the sound waves transmitted along discharge 24 while securing the plurality of tubes 34, 38 and 42 that are received in corresponding apertures 32 of the reflector 30. In one embodiment, reflector 30 is circular, but can have any peripheral shape that is received in a preferably substantially fluid tight conformal arrangement in discharge 24, preferably with reflector 30 disposed substantially perpendicular to the direction of refrigerant flow. It is preferred that the proportion of surface area of reflector 30 disposed in fluid communication in discharge 24 remaining after subtracting the surface area of apertures 32 is about ⅓. For example, if the cross sectional area of discharge 24 is 20 square inches, the reflector 30 would cover approximately 7 square inches of discharge 24. However, it is to be understood that this proportion value is merely a guide, and that the proportion can be greater than or less than ⅓.

Figure 5:
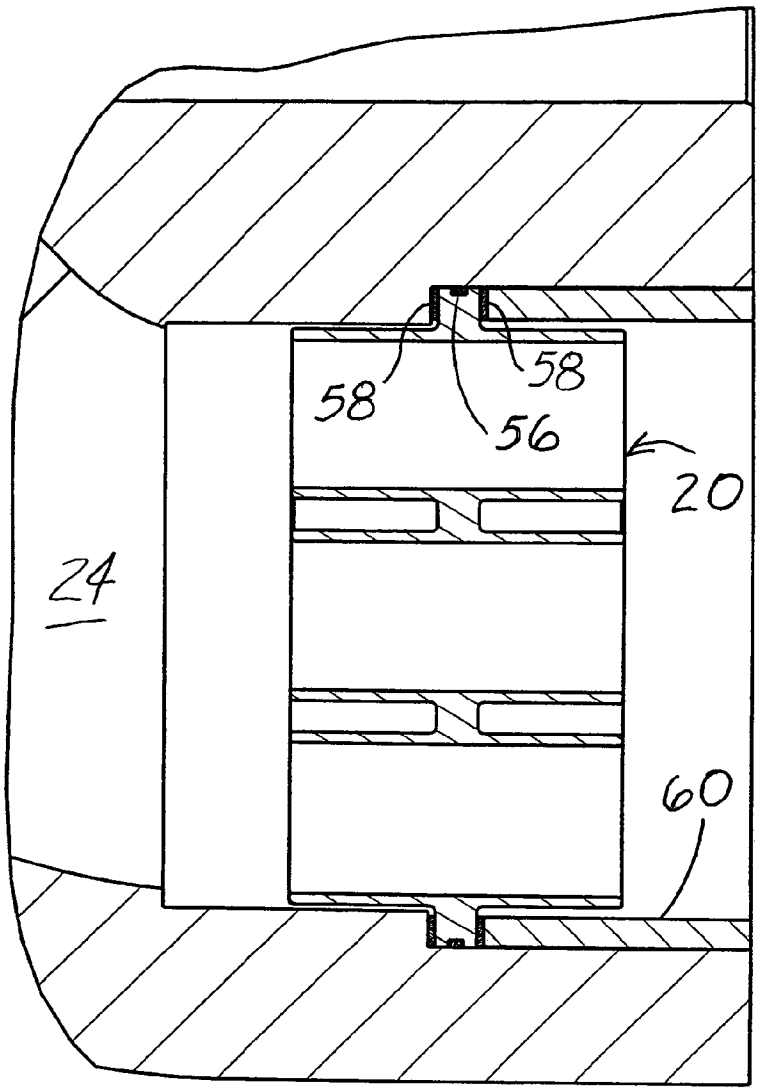
FIGS. 5-6 are cross sections of vibrationally isolated muffler arrangements of the present invention.
Figure 6:
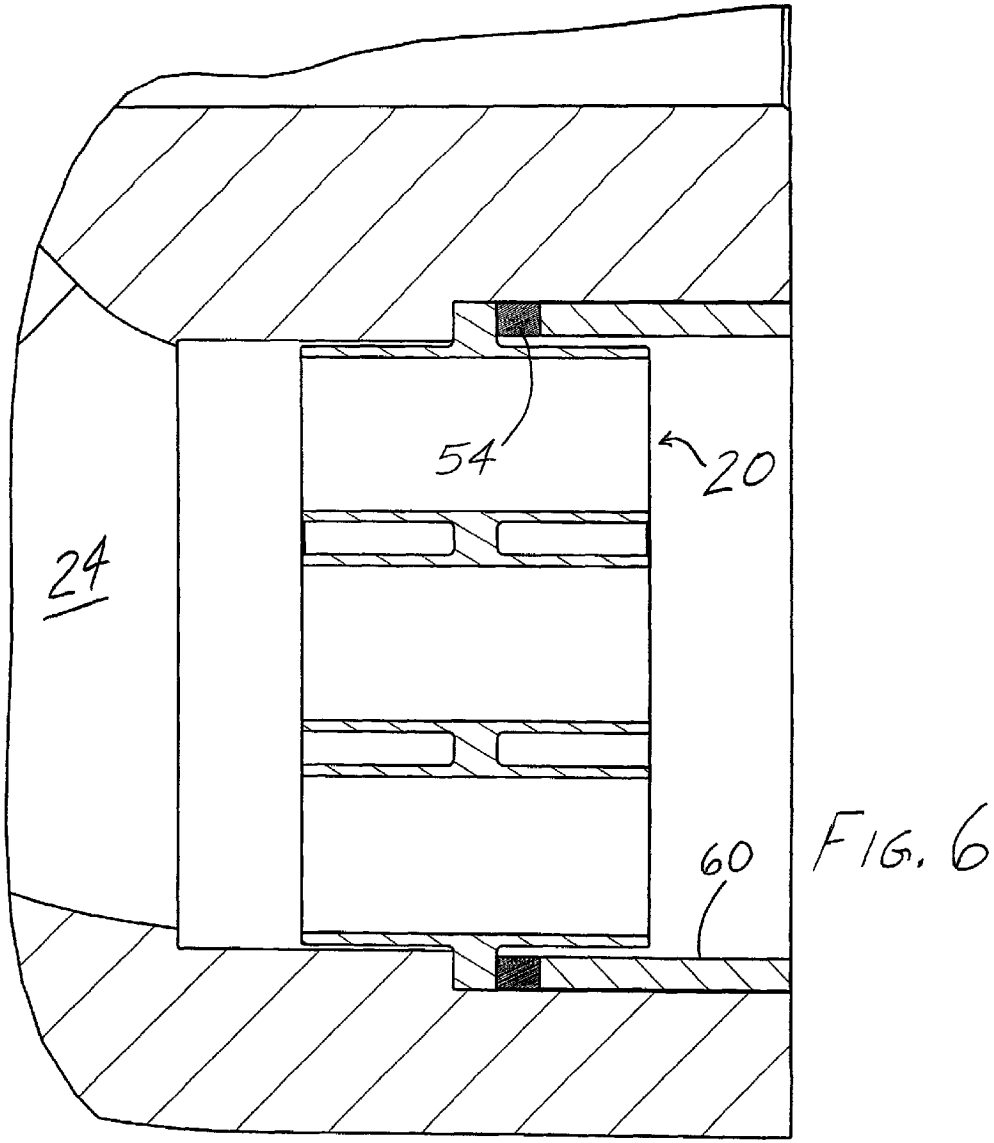

In addition to being preferably disposed in a substantially fluid tight conformal arrangement in discharge 24, reflector 30 may also be substantially vibrationally isolated from discharge 24. A gasket 54 can be disposed between reflector 30 and discharge 24, the gasket material preferably being a viscoelastic material, such as neoprene or other polymer, to damp vibrations that would other wise propagate from the reflector 30 to the compressor 10. Preferably, the reflector 10 is also sufficiently resilient when compressed to provide a substantially fluid tight seal between the discharge 24 and the reflector 30. In an alternate embodiment, gasket 54 can have a U-shaped cross section (see FIG. 4) having a pair of flanges 58 and an interconnecting web 56 disposed between the flanges 58 that can be secured to the periphery of the reflector 30. Alternately, the gasket flanges 58 and web 56 can be independent from each other (see FIG. 5), with a fitting 60, such as an annular shim, being used to apply a sufficient compressive force to secure the muffler 20 in position inside the discharge 24 while vibrationally isolating the muffler 20 from the discharge 24. In yet a further embodiment, gasket 54 can be a resilient cushion or spring, as shown in FIG. 6, although the cushion or spring can be located on either side or both sides of the reflector 30.

Figure 2:
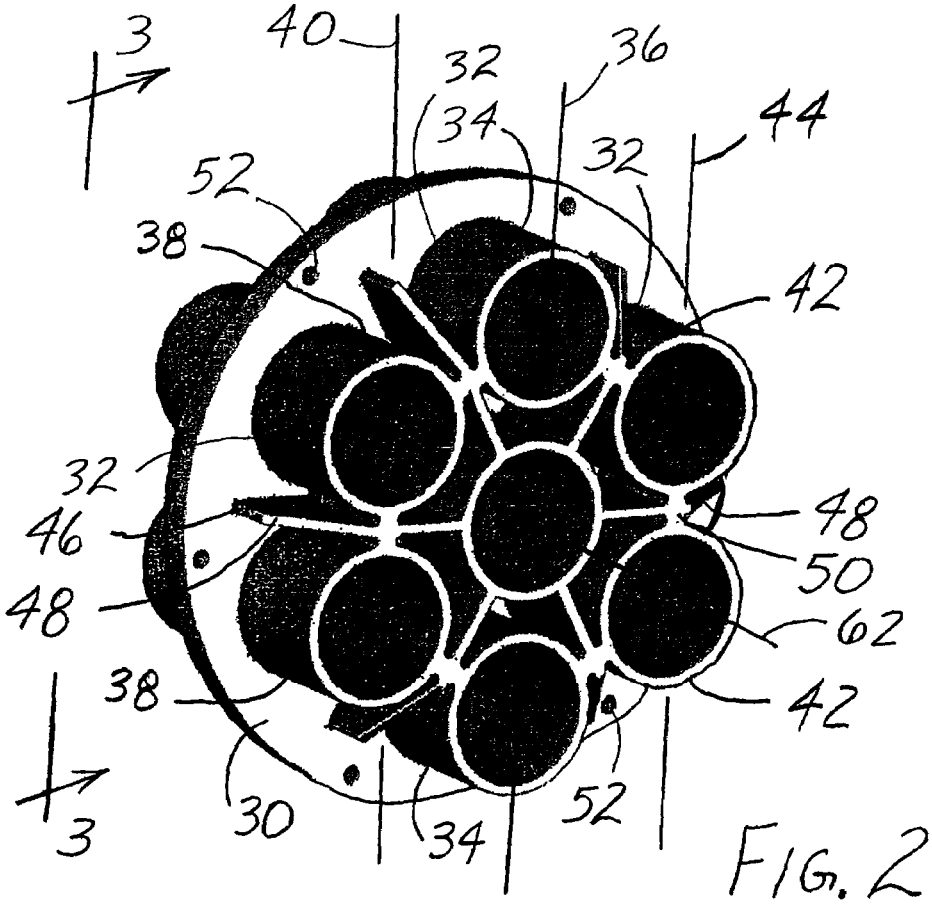
FIG. 2 is a perspective view of a discharge muffler of the present invention.
Figure 3:
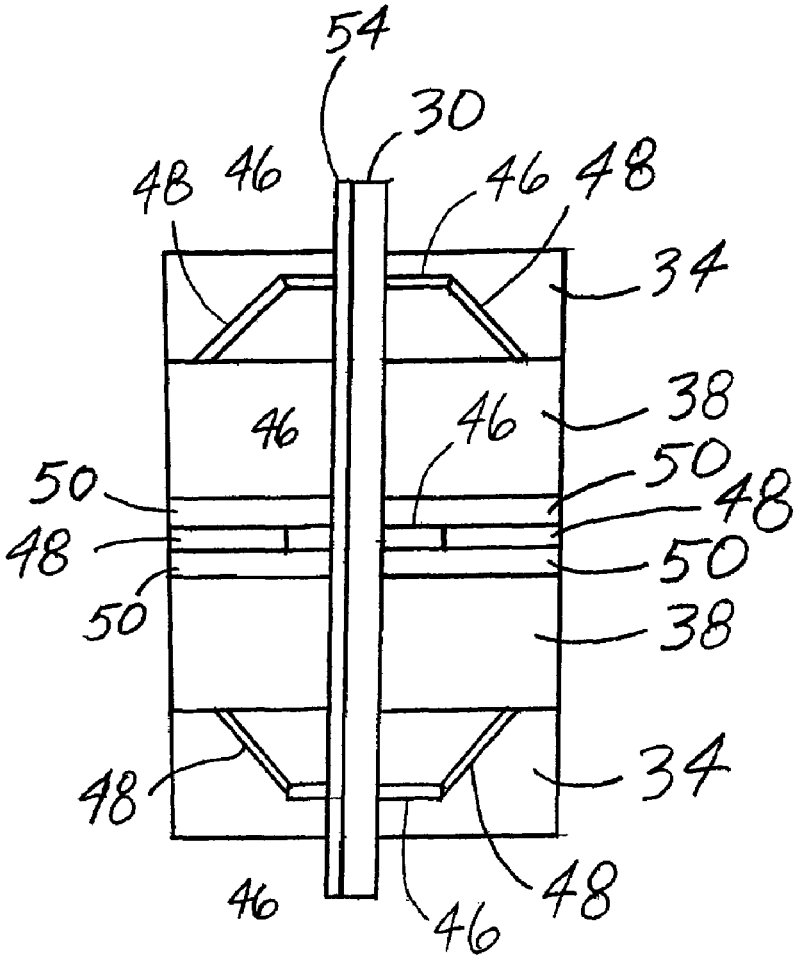
FIG. 3 is an elevation view taken along view 3-3 from FIG. 2.
Figure 4:
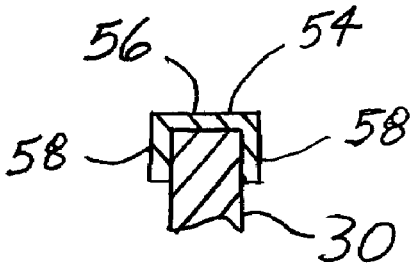
FIG. 4 is an enlarged partial cross section of a reflector fitted with an embodiment of a gasket of the present invention.

In one embodiment of the muffler 20 as shown in FIG. 2, tubes 34, 38 and 42 extend through reflector 30, with the centers of tubes 34 being aligned with a center line 36, tubes 38 aligned with a center line 40 and tubes 42 aligned with a center line 44. Preferably, sound waves reflecting off of plate 30 strike and attenuate sound waves entering the tubes 34, 38 and 42, the sound waves preferably being plane-waves for the muffler 20 to function properly, as three dimensional waves behave differently than plane-waves. Tubes are sized (tuned) to attenuate sound frequencies associated with operation of the compressor 10 by making use of a relationship that exists between the diameter of the tubes and the plane-wave frequency which can be maintained in the tubes. In this relationship, increasing tube diameter increases the frequency of plane-waves that can be maintained and attenuated, while decreasing tube diameter decreases the frequency of plane-waves that can be maintained and attenuated. For example, plane-waves can exist in 6 inch diameter tubes (with R-134a refrigerant) only below 540 Hz. A tube having a 3 inch diameter maintains plane-waves up to twice the frequency of a 6 inch diameter, or 1,080 Hz. Since a sound frequency of 720 Hz is a problematic frequency in some compressor constructions, a tube diameter of about 4½ inches, which can maintain plane-waves at that frequency, may be desirable. Therefore, it is preferable to use multiple tubes having smaller diameters so that muffler performance can be enhanced.

In addition to sizing the tube cross sectional area (diameter for round tubes) it is preferable to also control the tube length, as tube length is used to tune the tube to a particular frequency. For example, in one embodiment, a tube having a length of 1.75 inches, as measured from the surface of the plate 30 (0.50 inch thick) to the end of the tube, is tuned to 714 Hz. Preferably, this tube is 4.00 inches long, so that the remainder of the tube extends past the other side of the plate by the same length. In other words, it is preferable that the plate 30 substantially bisects the tubes 34, 38 and 42. Further, it is preferable that tubes 34, 38 and 42 are in substantially mutual axial alignment, running substantially perpendicular to the plate 30. To secure tubes 34, 38 and 42 in position, adhesive, chemical or mechanical bonding techniques, known in the art, including welding, can be employed. Alternatively, the tubes 34, 38 and 42 and the plate 30 can be of unitary construction.

Preferably extending from each side of the plate 30 between adjacent tubes 34, 38 and 42 are vanes 46, the vanes 46 further preferably extending radially outward from a center tube 34. The vanes 46 attenuate higher sound frequencies than the tubes 34, 38 and 42, which is believed to result, at least in part, to result from the vanes 46 forming additional tuned cavities of smaller cross sectional areas than the tubes. To further secure the vanes 46 extending between adjacent tubes, a joint 50 can be formed to at least one side or to opposite sides of the vane 46. While the vanes 46 can define a profile having any closed geometry, an embodiment shown in FIG. 2 includes a bevel 48 that provides enhanced structural stiffness and strength. Further, apertures can be formed in either or both of the vanes 46 and the tubes 34, 38 and 42, which can affect sound attenuation. Additional apertures can also be formed in the plate 30, so long is there is sufficient proportional surface area to reflect sound waves as previously discussed.

While in one embodiment the tubes 34, 38 and 42 and vanes 46 are symmetric about a center axis 62 (see FIG. 2), each tube being substantially the same length and diameter and each vane 46 being substantially identical, it is to be understood that such symmetry is not required, as even a centered tube on the plate 30 is not required, nor is it required that the tubes or vanes be of identical construction. Further, the tubes may define any closed geometric shape and have different lengths, and smaller tubes may be nested inside larger tubes, if desired. Although the tubes 34, 38 and 42, plate 30 and vanes 46 are preferably of integral metal construction, such as a welding, or alternately, unitary machined construction, such as casting, other compatible materials of sufficient strength, acoustic behavior and durability may also be used that can permit a molded construction.

Test results were conducted using an embodiment of the muffler 20 as shown in FIG. 2 on a conventional screw compressor wherein the reflector 30 had a reflective surface area proportion of approximately ⅓, as previously discussed. The resultant pressure drop of the discharged refrigerant vapor due to the muffler was only about ½ psi. However, due to an improved flow path of discharged vapor after flowing through the muffler of the present invention, an improvement in HVAC system performance of about 0.5 percent was observed while simultaneously providing an amount of sound attenuation comparable to that achieved by a conventional muffler. One skilled in the art can appreciate that other combinations of plate reflective proportionality, tube geometry, tube length as well as variations in compressor construction may provide even more favorable results, such as providing a pressure drop of refrigerant flowing through the muffler from between about 0.1 psi to about 1.0 psi.

Figure 7:
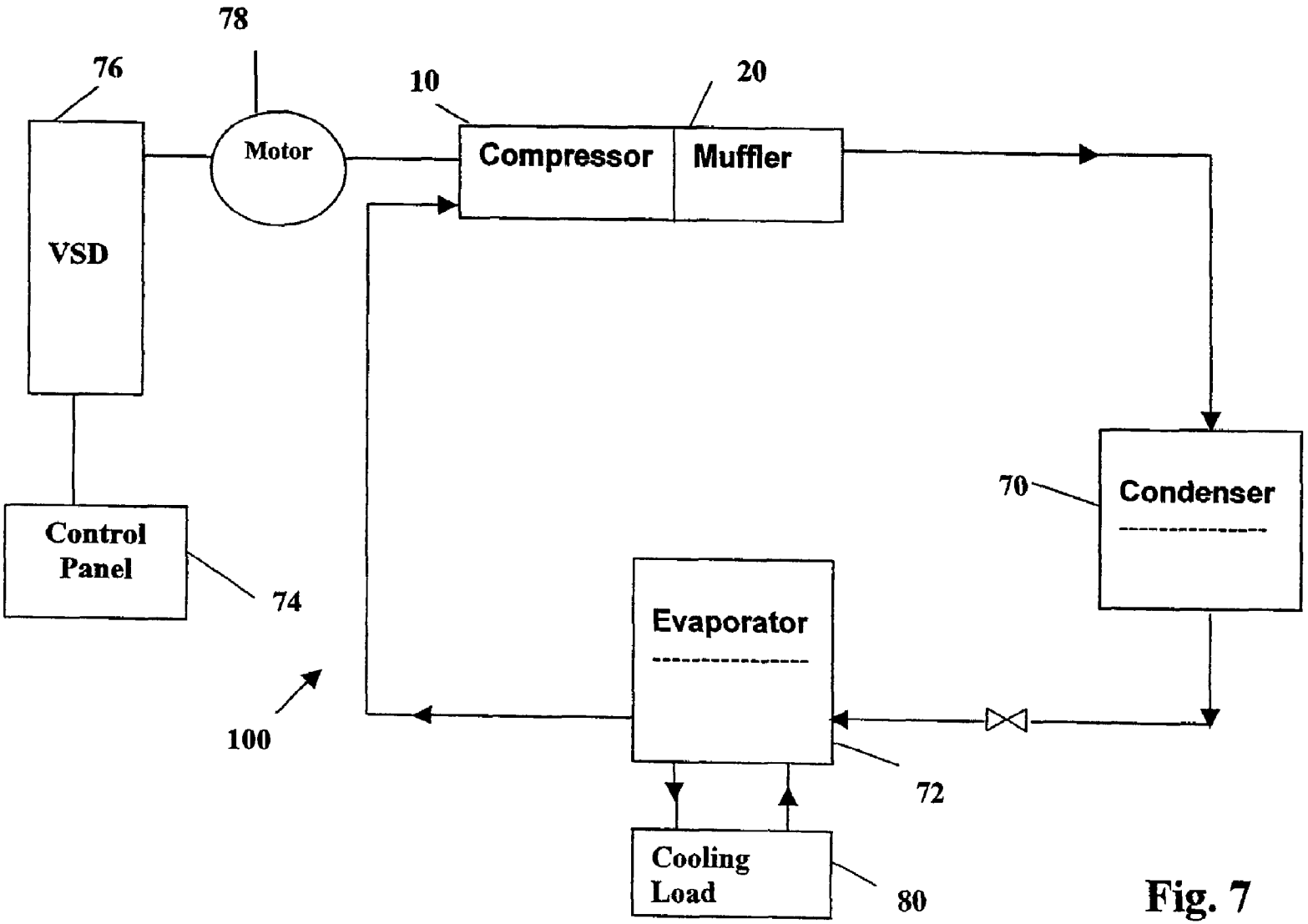
FIG. 7 is a schematic of a refrigeration system usable with the muffler of the present invention.

FIG. 7 illustrates generally one embodiment of the present invention incorporated in a refrigeration system. As shown, a HVAC, refrigeration or liquid chiller system 100 includes the compressor 10 having the muffler 20 as previously discussed, a condenser arrangement 70, expansion devices, a water chiller or evaporator arrangement 72 and a control panel 74. The control panel 74 controls operation of the refrigeration system 100. The control panel 74 can also be used to control the operation of a driving device, such as a variable speed drive or VSD 104, a motor 78 and the compressor 10. A conventional HVAC, refrigeration or liquid chiller system 100 includes many other features that are not shown in FIG. 7. These features have been purposely omitted to simplify the drawing for ease of illustration.

The compressor 10 compresses a refrigerant vapor and delivers it to the condenser 70 after the flow of the refrigerant vapor has been improved by the muffler 20 as previously discussed. The refrigerant vapor delivered to the condenser 70 enters into a heat exchange relationship with a fluid, e.g., air or water, and undergoes a phase change to a refrigerant liquid as a result of the heat exchange relationship with the fluid. The condensed liquid refrigerant from condenser 70 flows through corresponding expansion devices to an evaporator 72.

The evaporator 72 can include connections for a supply line and a return line of a cooling load 80. A secondary liquid, which is preferably water, but can be any other suitable secondary liquid, e.g., ethylene, calcium chloride brine or sodium chloride brine, travels into the evaporator 72 via return line and exits the evaporator 72 via supply line. The liquid refrigerant in the evaporator 72 enters into a heat exchange relationship with the secondary liquid to chill the temperature of the secondary liquid. The refrigerant liquid in the evaporator 72 undergoes a phase change to a refrigerant vapor as a result of the heat exchange relationship with the secondary liquid. The vapor refrigerant in the evaporator 72 then returns to the compressor 10 to complete the cycle. It is to be understood that any suitable configuration of condenser 70 and evaporator 72 can be used in the system 100, provided that the appropriate phase change of the refrigerant in the condenser 70 and evaporator 72 is obtained.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A discharge muffler (20) in a HVAC&R system (100), the discharge muffler (20) comprising:

a plate (30);

a plurality of tubes (34, 38, 42) configured and disposed to extend through the plate (30) substantially perpendicular to the plate (30), the plurality of tubes (34, 38, 42) disposed in a predetermined spacing arrangement to provide substantially mutual axial alignment of the plurality of tubes (34, 38, 42); and at least one vane (46) configured and disposed between adjacent tubes of the plurality of tubes (34, 38, 42);

wherein the at least one vane (46) is interconnected to said adjacent tubes of the plurality of tubes (34, 38, 42).

2. The discharge muffler (20) of claim 1 wherein at least one tube of the plurality of tubes (34, 38, 42) has a cross sectional area that is different from the remaining tubes of the plurality of tubes (34, 38, 42).

3. The discharge muffler (20) of claim 1 wherein at least one tube of the plurality of tubes (34, 38, 42) has a substantially circular cross section.

4. The discharge muffler (20) of claim 1 wherein the plurality of tubes (34, 38, 42) and plate (30) are of integral construction.

5. The discharge muffler (20) of claim 1 wherein the plurality of tubes (34, 38, 42) and plate (30) are of unitary construction.

6. The discharge muffler (20) of claim 1 wherein the at least one vane (46) has a bevel (48).

7. The discharge muffler (20) of claim 1 further comprises a gasket (54) disposed along a periphery of the plate (30).

8. The discharge muffler (20) of claim 7 wherein the gasket (54) has a U-shaped cross section configured to substantially vibrationally isolate the plate (30) from the HVAC&R system (100).

9. A compressor system in a HVAC&R system (100) comprising:

a compressor (10) having a housing, the housing having an inlet for receiving refrigerant to be compressed by the compressor and an outlet (24) for discharging pressurized compressed refrigerant; and a muffler (20) disposed in the outlet, the muffler (20) comprising:

a plate (30);

a plurality of tubes (34, 38, 42) configured and disposed to extend through the plate (30) substantially perpendicular to the plate (30) and substantially parallel with the direction of refrigerant flow from the outlet (24), the plurality of tubes (34, 38, 42) disposed in a predetermined spacing arrangement to provide substantially mutual axial alignment of the plurality of tubes (34, 38, 42); and at least one vane (46) configured and disposed between adjacent tubes of the plurality of tubes (34, 38, 42);

wherein the at least one vane (46) is interconnected to said adjacent tubes of the plurality of tubes (34, 38, 42).

10. The compressor system of claim 9 wherein at least one tube of the plurality of tubes (34, 38, 42) has a cross sectional area that is different from the remaining tubes of the plurality of tubes (34, 38, 42).

11. The compressor system of claim 10 wherein at least one tube of the plurality of tubes (34, 38, 42) has a substantially circular cross section.

12. The compressor system of claim 10 wherein the plurality of tubes (34, 38, 42) and plate (30) are of integral construction.

13. The compressor system of claim 9 wherein the plurality of tubes (34, 38, 42) and plate (30) are of unitary construction.

14. The compressor system of claim 9 wherein the at least one vane (46) has a bevel (48) configured to provided structural stiffness for the vane (46).

15. The compressor system of claim 9 further comprises a gasket (54) disposed along a periphery of the plate (30).

16. The compressor system of claim 15 wherein the gasket (54) has a U-shaped cross section configured to substantially vibrationally isolate the plate (30) from the HVAC&R system (100).

17. The compressor system of claim 9 wherein a proportion of surface area of the plate (30) disposed in fluid communication with the outlet is about ⅓.

18. The compressor system of claim 9 further comprises a gasket (54) disposed between the outlet (24) and the plate (30).

19. The compressor system of claim 18 wherein the gasket (54) is a viscoelastic material.

20. The compressor system of claim 19 wherein the gasket (54) has a cross section defined by a pair of flanges (58) interconnected by a web (56) disposed between the pair of flanges (58), the gasket (54) secured to a periphery of the plate (30), wherein one flange (58) of the pair of flanges (58) is disposed between the outlet (24) and the plate (30).

21. The compressor system of claim 9 further comprises at least one gasket (54), a first gasket of the at least one gasket disposable between the outlet (24) and the plate (30), and a second gasket (54) of the at least one gasket (54) disposable adjacent the plate (30) opposite the first gasket.

22. The compressor system of claim 21 wherein the at least one gasket (54) is a cushion or a spring.

23. A chiller system (100) comprising:

a compressor (10), a condenser arrangement (70) and an evaporator arrangement (72) connected in a closed refrigerant loop;

a muffler (20) comprising:

a plate (30); and a plurality of tubes (34, 38, 42) configured and disposed to extend through the plate (30) substantially perpendicular to the plate (30) and substantially parallel with the direction of refrigerant flow from the compressor (10), the plurality of tubes (34, 38, 42) disposed in a predetermined spacing arrangement to provide substantially mutual axial alignment of the plurality of tubes (34, 38, 42); and at least one vane (46) configured and disposed between adjacent tubes of the plurality of tubes (34, 38, 42);

wherein the at least one vane (46) is interconnected to said adjacent tubes of the plurality of tubes (34, 38, 42); and wherein the muffler (20) being disposed in the closed refrigerant loop between the compressor (10) and the condenser (70).

24. The chiller system of claim 23 wherein the muffler (20) is configured to achieve a minimal pressure drop of refrigerant flowing through the muffler (20).

25. The compressor chiller system of claim 24 wherein the pressure drop is between about 0.1 psi and about 1.0 one psi.

* * * * *

UNITED STATES PATENT AND TRADEMARK OFFICE

CERTIFICATE OF CORRECTION

PATENT NO. : 7,578,659 B2
APPLICATION NO. : 11/047552
DATED : August 25, 2009
INVENTOR(S) : Fox et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 816 days.

Signed and Sealed this

Seventh Day of September, 2010

David J. Kappos

David J. Kappos
*Director of the United States Patent and Trademark Office*